US008908893B2

(12) United States Patent
Alfsmann et al.

(10) Patent No.: US 8,908,893 B2
(45) Date of Patent: Dec. 9, 2014

(54) HEARING APPARATUS WITH AN EQUALIZATION FILTER IN THE FILTER BANK SYSTEM

(75) Inventors: Daniel Alfsmann, Bochum (DE); Robert Bäuml, Eckental (DE); Henning Puder, Erlangen (DE); Wolfgang Sörgel, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 664 days.

(21) Appl. No.: 12/469,014

(22) Filed: May 20, 2009

(65) Prior Publication Data

US 2009/0290734 A1 Nov. 26, 2009

(30) Foreign Application Priority Data

May 21, 2008 (DE) ..... 10 2008 024 534

(51) Int. Cl.
*H04R 25/00* (2006.01)

(52) U.S. Cl.
CPC ..... *H04R 25/505* (2013.01); *H04R 2430/03* (2013.01); *H04R 25/407* (2013.01)
USPC ..... 381/317; 381/318; 381/322; 381/61; 375/350

(58) Field of Classification Search
USPC ..... 381/312–321, 17, 61; 375/350
See application file for complete search history.

(56) References Cited

U.S. PATENT DOCUMENTS 5,016,280 A * 5/1991 Engebretson et al. ..... 381/320
5,233,665 A * 8/1993 Vaughn et al. ..... 381/97
5,544,140 A * 8/1996 Seagrave et al. ..... 369/59.21
5,714,918 A * 2/1998 Menkhoff ..... 333/28 R
6,263,017 B1 * 7/2001 Miller ..... 375/222
7,003,120 B1 * 2/2006 Smith et al. ..... 381/61

(Continued)

FOREIGN PATENT DOCUMENTS

WO WO9802983 A1 1/1998

OTHER PUBLICATIONS

Karl-Dirk Kammeyer, Kristian Kroschel: "Digitale Signalverarbeitung, Filterung and Spektralanalyse mit MATLAB-Übungen" (Digital signal processing, filtering and spectral analysis with MATLAB exercises), 7th edition, Teubner Verlag 2006, Chapter 4.1, pp. 82-86.

Göckler, Heinz G.; Groth, Alexandra: Multiratensysteme Abtastratenumsetzung und digitale Filterbänke, Wildburgstetten, Schlembach Verlag, 2004, S. 397-399.

(Continued)

*Primary Examiner* — Eugene Lee
*Assistant Examiner* — Fang-Xing Jiang
(74) *Attorney, Agent, or Firm* — Laurence A. Greenberg; Werner H. Stemer; Ralph E. Locher

(57) ABSTRACT

Multi-stage filter bank systems with filter banks of different bandwidth frequently cause interference in hearing apparatuses and in particular in hearing devices. Therefore a hearing apparatus is proposed with a filter bank system having a multi-stage analysis filter bank and/or a multi-stage synthesis filter bank, to break down an input signal of the hearing apparatus into a number of partial band signals by way of a number of filter bank channels and/or to recombine partial band signals of a number of filter bank channels. The filter bank system is equipped with at least one equalization filter, to equalize differences in the complex frequency responses between filter bank channels. It is thus possible in particular to equalize group delay time differences as well as attenuation and/or amplification.

18 Claims, 4 Drawing Sheets

(56) References Cited

U.S. PATENT DOCUMENTS

| | | | | |
|---|---|---|---|---|
| 2002/0085654 | A1* | 7/2002 | Cvetkovic | 375/350 |
| 2002/0191840 | A1* | 12/2002 | Ochi et al. | 382/154 |
| 2003/0053646 | A1* | 3/2003 | Nielsen et al. | 381/312 |
| 2005/0008176 | A1* | 1/2005 | Pedersen | 381/316 |
| 2005/0185798 | A1 | 8/2005 | Camey | |

OTHER PUBLICATIONS

Karl-Dirk Kammeyer, Kristian Kroschel: "Digitale Signalverarbeitung, Filterung and Spektralanalyse mit MATLAB-Übungen" (Digital signal processing, filtering and spectral analysis with MATLAB exercises), $6^{th}$ edition, Teubner Verlag 2006, Chapter 4.1, pp. 78.

* cited by examiner

HEARING APPARATUS WITH AN EQUALIZATION FILTER IN THE FILTER BANK SYSTEM

CROSS REFERENCE TO RELATED APPLICATIONS

This application claims priority of German application No. 10 2008 024 534.8 DE filed May 21, 2008, which is incorporated by reference herein in its entirety.

FIELD OF INVENTION

The present invention relates to a hearing apparatus with a filter bank system, having a multi-stage analysis filter bank and/or a multi-stage synthesis filter bank, to break down an input signal of the hearing apparatus into a number of partial band signals by way of a number of filter bank channels and/or to recombine partial band signals of a number of filter bank channels. The term "hearing apparatus" here refers to any device that can be worn on the ear and emits sound, in particular a hearing device, a headset, headphones, etc.

BACKGROUND OF INVENTION

Hearing devices are wearable hearing apparatuses used to assist those with impaired hearing. To meet the numerous individual requirements different designs of hearing device are available, such as behind-the-ear hearing devices (BTE), hearing devices with an external earpiece (RIC: receiver in the canal) and in-the-ear hearing devices (ITE), e.g. also concha hearing devices or canal hearing devices (CIC). The hearing devices mentioned by way of example are worn on the outer ear or in the auditory canal. In addition to these designs however there are also bone conduction hearing aids, implantable or vibro-tactile hearing aids available on the market. With these the damaged hearing is stimulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker, or as an electromechanical converter, e.g. a bone conduction earpiece. The amplifier is usually integrated into a signal processing unit. This basic structure is shown in FIG. 1, using a behind the ear hearing device 1 as an example. One or more microphones 2 for receiving the sound from the surroundings is/are built into a hearing device housing 1 to be worn behind the ear. A signal processing unit 3 which is also integrated into the hearing device housing 1 processes the microphone signals and amplifies them. The output signal of the signal processing unit 3 is transmitted to a loudspeaker or earpiece 4 which outputs an acoustic signal. The sound is optionally transmitted by way of a sound tube, which is fixed with an otoplastic in the auditory canal, to the hearing device wearer's eardrum. The power is supplied to the hearing device and especially to the signal processing unit 3 by a battery 5 also integrated into the hearing device housing 1.

SUMMARY OF INVENTION

Sound signals, which are received with one or more microphones of a hearing apparatus and in particular of a hearing device, are frequently broken down into K partial band signals by means of one or more frequency-selective digital analysis filter banks (AFB). The partial band signals are then subjected to a partial band-specific signal manipulation. The manipulated partial band signals are finally resynthesized by means of a digital synthesis filter bank (SFB). In this process the breaking down and resynthesis are effected by a filter bank made up of at least two cascaded stages or a partially at least two-stage (analysis) filter bank for breaking down the input signal into K partial band signals with a reduced sampling rate. The filter bank system here is designed so that the K partial band signals to be manipulated have a different bandwidth $B_i$ where i=1, . . . I and $2 \leq I < K$.

The filter bank system as a whole thus consists of a multi-stage AFB and a multi-stage SFB. The individual filter banks can respectively be conventional complex-modulated filter banks.

The filter bank outlined above for generating partial band signals of different bandwidths $B_i$, where i=1, . . . , I and $2 \leq I < K$ brings about a delay (group delay time) of the K partial band signals, which is a function of the respective signal and/or channel bandwidth $B_i$. This results in jumps in the overall signal delay between the partial band signals or partial band signal groups of different bandwidth $B_i$, which interfere with the signal quality.

A noise reduction filter with a short delay is known from the publication WO 98/02983. An analysis filter bank breaks an input signal down into two output channels. The signal of the first channel is an estimation of a periodic component of the input signal and the signal of the second channel is an estimation of a non-periodic component of the input signal. In the first channel the signal is subject to a delay, while the signal in the second channel passes through a noise reduction filter.

A maximum-depletion M-channel analysis filter bank in a tree structure is also disclosed in Göckler, Heinz G.; Groth Alexandra: Multiratensysteme Abtastratenumsetzung und digitale Filterbanke (Multirate systems, sampling rate conversion and digital filter banks), Wildburgstetten, Schlembachverlag 2004, pages 397 to 399. The filter bank has three stages.

The object of the present invention is therefore to improve signal quality when processing signals in hearing apparatuses with the aid of multi-stage filter banks.

According to the invention this object is achieved by a hearing apparatus with a filter bank system, having a multi-stage analysis filter bank and/or a multi-stage synthesis filter bank, to break down an input signal of the hearing apparatus into a number of partial band signals by way of a number of filter bank channels and/or to recombine partial band signals of a number of filter bank channels, the filter bank system being equipped with at least one equalization filter to equalize differences in the frequency responses between filter bank channels.

It is advantageously possible with the equalization filter (equalizer) to equalize the different group delay times and optionally different magnitude profiles of the frequency responses of the filter bank channels or to round or smooth delay time jumps.

It is thus possible to eliminate discontinuities in the frequency response of the filter bank system and to suppress the interference associated therewith.

Both the analysis filter bank and the synthesis filter bank preferably have a multi-stage structure and the equalization filter is preferably disposed between two hierarchical levels of filters in the filter bank system. Alternatively the equalization filter can be disposed in the lowest stage of the analysis filter bank or synthesis filter bank. Thus only one or more equalizers are required, operating at the lowest sampling rate and therefore requiring less computation outlay.

Alternatively the equalization filter can also be disposed in the top stage of the synthesis filter bank. This has the advantage that the group delay time/magnitude frequency response transition can be distributed over the maximum frequency width, namely the entire signal bandwidth.

The equalization filter is preferably disposed in the synthesis filter bank. This allows distortions, which originate from the analysis filter bank, also to be equalized.

Preferably at least two pairs of adjacent filter banks are present in the filter bank system, having different bandwidths from one another, so that two filter bank channels of different width are respectively adjacent to one another in each filter bank pair and one equalization filter is disposed respectively to increase the group delay time in the broader of the two filter bank channels respectively. This allows a constant transition of the group delay time to be achieved without further ado at the partial band boundaries.

BRIEF DESCRIPTION OF THE DRAWINGS

The present invention is described in more detail with reference to the accompanying drawings, in which.

DETAILED DESCRIPTION OF INVENTION

The exemplary embodiments described in more detail below represent preferred embodiments of the present invention.

Figure 1:
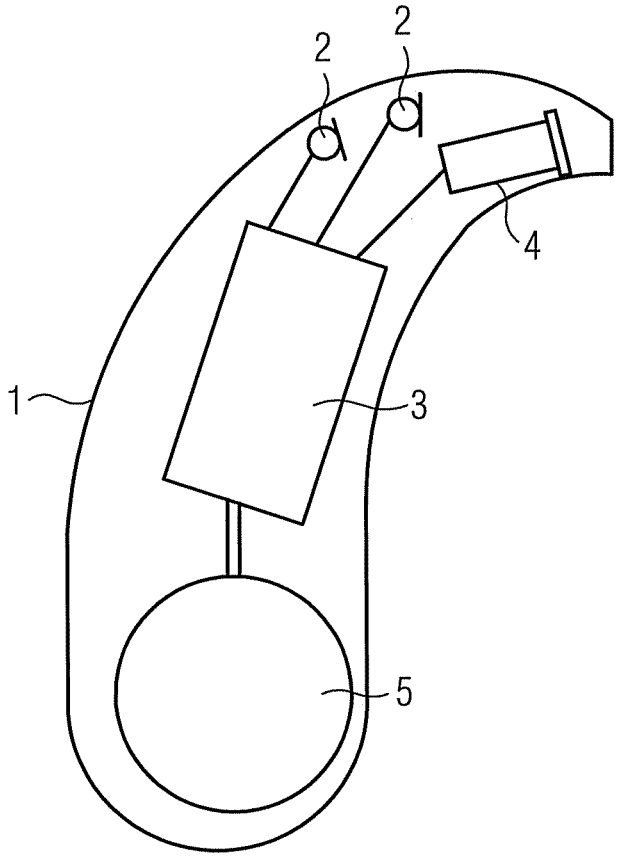
FIG 1 (Prior art)
FIG. 1 shows the basic structure of a hearing device according to the prior art.
Figure 2:
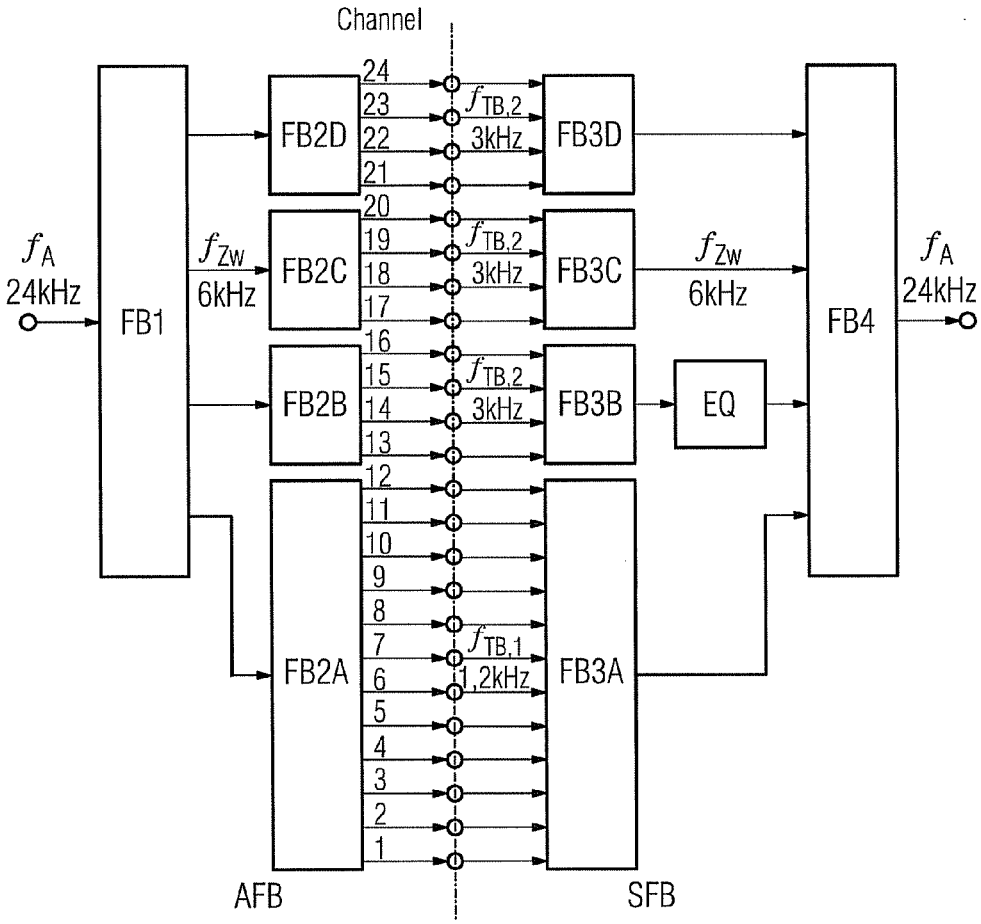
FIG. 2 shows the structure of an entire filter bank cascade of AFB and SFB with equalizer.

FIG. 2 shows a filter bank cascade consisting of a multi-stage analysis filter bank (AFB) and a multi-stage synthesis filter bank (SFB). The exemplary filter bank is used for signal processing in a hearing apparatus and in particular in a hearing device. The input-side filter bank (FB1) of the AFB breaks the input signal down into four channels. The output-side filter banks FB2A, FB2B, FB2C and FB2D break the four channels down further ultimately into 24 channels. In this process the lowest channel of the FB1 is broken down by the FB2A into twelve channels, while the other three channels of the FB1 are broken down with the aid of the output-side filter banks FB2B, FB2C and FB2D respectively into four channels. The input sampling rate of the FB1 is for example 4 kHz. The sampling rate between the two filter bank stages $f_{Zw}$ in the selected example is 6 kHz. The sampling rates in the partial band channels at the output of the AFB is therefore 3 kHz respectively in the high frequency groups, in other words after the filter banks FB2B, FB2C and FB2D. The sampling rate after the filter bank FB2A of the lower frequency group is 1.2 kHz. Downward sampling advantageously takes place here.

After the AFB a partial band-specific signal manipulation is carried out (not shown in FIG. 2). For the sake of clarity the SFB for resynthesizing the signal is directly adjacent to the AFB in FIG. 2. In respect of the filter banks the SFB is structured symmetrically in relation to the AFB in the individual stages. Thus in the lowest stage of the SFB are the filter banks FB3A, FB3B, FB3C and FB3D, which respectively combine twelve or four partial band signals to form one signal. The four resulting signals with a sampling rate of 6 kHz are supplied to the higher synthesis stage FB4, which combines the signals to form an output signal with a sampling rate of 24 kHz.

Figure 3:
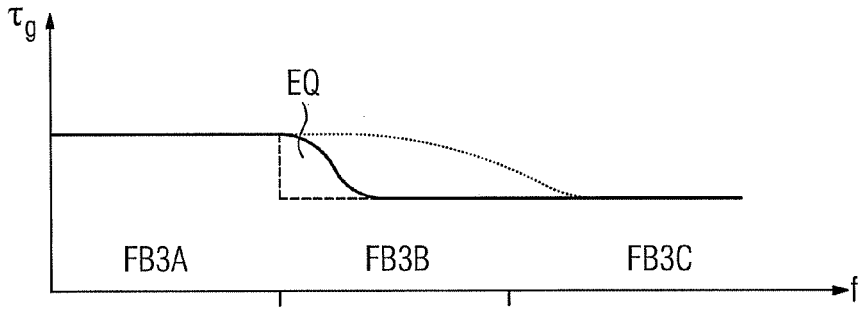
FIG. 3 shows a group delay time diagram over a number of the partial bands of the filter banks in FIG. 2.

The broader filter banks FB2A and FB3A in the lower frequency group also result here in an increased group delay time $\tau_g$ compared with the next frequency group up with the narrower filter banks FB2B and FB3B. This can be seen in FIG. 3. For the sake of clarity only the effects of the filter banks FB3A, FB3B and FB3C of the synthesis filter bank are shown here. A group delay time jump, shown with a broken line, would result at the boundary between the two filter banks FB3A and FB3B. Such a jump would however result in interference in the output signal.

According to the invention therefore an equalization filter (equalizer EQ) is connected downstream of the filter bank FB3B. This equalization filter EQ increases the group delay time of the filter bank FB3B at the upper (higher frequency) band edge to the value of the group delay time of the filter bank FB3A at its lower band edge. This results in the continuous, constant profile between the two filter banks FB3A and FB3B in FIG. 3. Interference in the output signal due to group delay time differences between the filter banks can thus be largely avoided. The equalization filter EQ can however also be disposed at other places in the AFB-SFB system. This would for example allow the dotted transition of the group delay time from the value of the filter bank FB3A to the value of the filter bank FB3C in FIG. 3 (more detail below).

According to the basic concept of the present invention an AFB-SFB system is generally equipped with at least one equalizer EQ, to reduce group delay time differences and/or attenuation/amplification differences between filter bank channels of different bandwidth $B_i$. The equalization function here should always relate to the instance where the partial band signals of the AFB-SFB filter bank are not subject to any manipulation, in other words a so-called "rest state" prevails. The purpose of the adjustment method here is not the absolute adjustment of the characteristics of the filter bank channels of different bandwidth but to extend the abrupt transitions of the transmission characteristics, which are limited to a very narrow-band frequency range, to a broader frequency band, in order thereby to avoid interfering artifacts. Generally therefore the equalization filter is to be used to increase group delay times in certain partial bands or to modify attenuations/amplifications as desired. In one specific instance, as in the example in FIG. 3, the group delay time of the filter bank FB3B at the upper band edge could be increased from the value of the group delay time of the filter bank FB3C to the value of the group delay time of the filter bank FB3A at the lower band edge.

Further exemplary embodiments of an arrangement of one or more equalization filters EQ in the filter bank system are illustrated below:

For example an equalization filter EQ can also be integrated in the AFB. In particular it could be connected, as in the example in FIG. 2, between the output of the filter bank FB1 and the input of the filter bank FB2B. If there are a number of microphones, which also require a number of AFBs, this would result in an increased outlay.

According to a further exemplary embodiment an equalization filter could be provided on the lowest level of the partial bands in the broader (3 kHz) channel with the lowest center frequency. In this instance the transition range is only extended over one channel (of bandwidth 3 kHz), while with an arrangement of the equalization filter in a higher level it can extend over 3×3 kHz for example. Alternatively one equalization filter must be deployed respectively in four adjacent 3 kHz channels. The advantage of using just one or two equalization filters on this lowest level is that they can operate at the lowest sampling rate and thus generally require less computation outlay.

In a further exemplary embodiment the equalization filter EQ is disposed in the highest level of the cascaded filter bank system, in this instance at the output of the filter bank FB4. Thus requires a higher sampling rate and therefore a greater outlay but the group delay time—or magnitude frequency response—transition can be distributed over the maximum frequency width, i.e. the entire signal bandwidth (see dotted line in FIG. 3).

In a further exemplary embodiment the filter bank system has more than two different bandwidths. An equalization filter EQ is provided at each transition between adjacent channels of different bandwidth. In this process the equalization filter is to be disposed respectively in the channel with the larger bandwidth, as it has to increase the group delay time there. In the case of a magnitude frequency response equalization the amplifying or reducing equalization filter EQ can also be disposed in the respective other channel.

As the exemplary embodiments illustrated above show, the inventive introduction of equalizers or equalization filters EQ in individual filter bank channels at a different hierarchical level avoids abrupt transitions of the attenuation/amplification and/or the group delay time. It is particularly advantageous if the smallest possible number of equalization filters EQ is deployed, by disposing them at those points where they are most effective. They can however also be disposed where they incur the least computation outlay.

Figure 4:
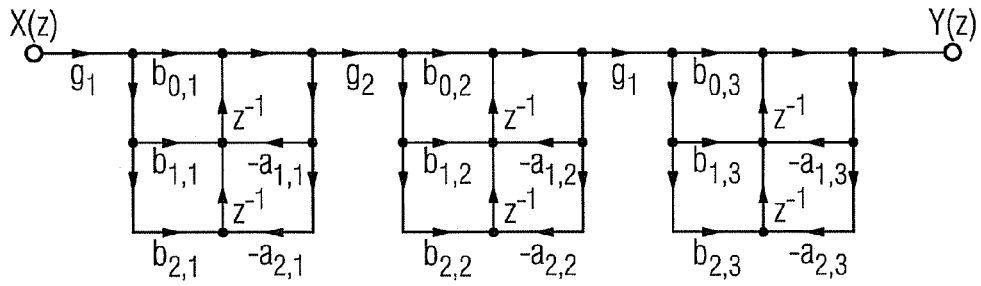
FIG. 4 shows the structure of an equalization filter realized as a cascade of second-order recursive structures.

The equalization filter EQ, which can be used to extend transitions of the transmission characteristics limited to a very narrowband frequency range to a broader frequency band, can be realized in many different ways. Some specific examples of realization are listed below:

1. Recursive (IIR) realization of the equalizer EQ with one of the two direct forms (=$1^{st}$ and $2^{nd}$ canonic form from Karl-Dirk Kammeyer, Kristian Kroschel: "Digitale Signalverarbeitung, Filterung and Spektralanalyse mit MATLAB-Übungen" (Digital signal processing, filtering and spectral analysis with MATLAB exercises), $6^{th}$ edition, Teubner Verlag 2006, chapter 4.1, pages 78 ff.) with high coefficient sensitivity. A further realization option is the cascade form (=$3^{rd}$ canonic form; see also K-D Kammeyer et al. as above) with low coefficient sensitivity. FIG. 4 shows such a structure of the equalization filter EQ. it behaves in the manner of an all-pass for example and represents a conventional cascade of second order recursive filters. The filter coefficients of EQ should be converted to this form using the MATLAP function tf2sos for example. The sixth order all-pass thus gives rise to three second order sections (γ=2, 3) with the amplification factor $g_\gamma$, the coefficient of the FIR portion $b_{0,\gamma}$, $b_{1,\gamma}$, $b_{2,\gamma}$ and the coefficients of the IIR portion $a_{1,\gamma}$, $a_{2,\gamma}$. Finally the equalizer EQ can also be realized with a parallel form (=$4^{th}$ canonic form; see also K-D Kammeyer et al. as above) with low coefficient sensitivity.

2. Non-recursive (FIR) realization of the equalizer EQ with one of the two direct forms (=$1^{st}$ and $2^{nd}$ canonic form) with in this instance low coefficient sensitivity but also with the cascade form (=$3^{rd}$ canonic form) with low coefficient sensitivity (see also K-D Kammeyer et al. as above).

3. Embodiment of the equalizer for the combined equalization of magnitude frequency response and group delay time: realization as IIR system or as FIR system with asymmetrical pulse response (coefficient) according to points 1 and/or 2 above.

4. Embodiment of the equalizer for the sole equalization magnitude frequency responses of filter bank channels: realization as IIR system or as linear-phase FIR system with symmetrical pulse response (coefficient) according to points 1 and/or 2 above.

Figure 5:
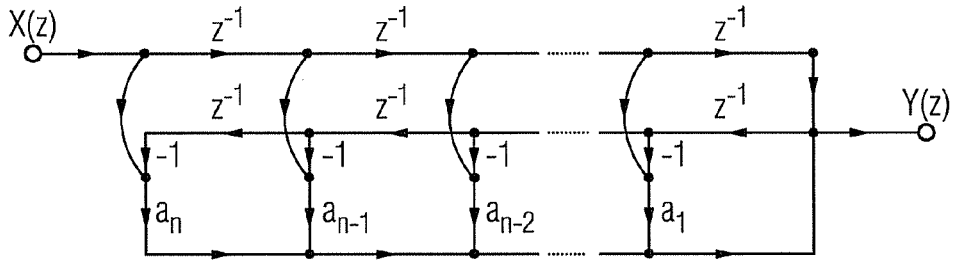
FIG. 5 shows an all-pass structure with minimum multiplier number.

5. Embodiment of the equalizer for the sole equalization of the group delay time of filter bank channels: realization as IIR all-pass according to point 1 above. The equalizer according to FIG. 5 can also be realized as a very efficient all-pass (see K-D Kammeyer et al., chapter 4.3 "All-passes"). The all-pass structure in FIG. 5 is not canonic in respect of the storage unit, as 2n storage unit elements are required for an nth order system, but it manages with the minimum number of multipliers, namely n+1. From the point of view of realization outlay this structure therefore has advantages compared with the canonic form.

Figure 6:
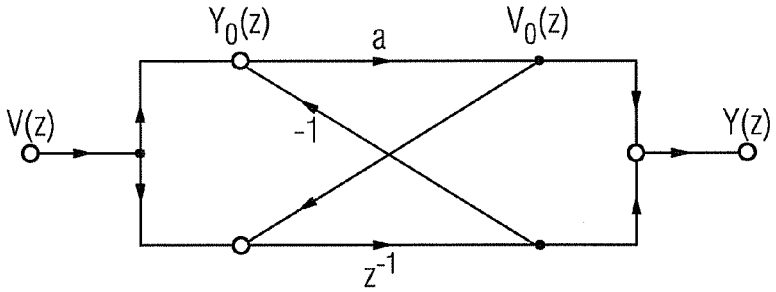
FIG. 6 shows a signal flow graph of a first degree all-pass.
Figure 7:
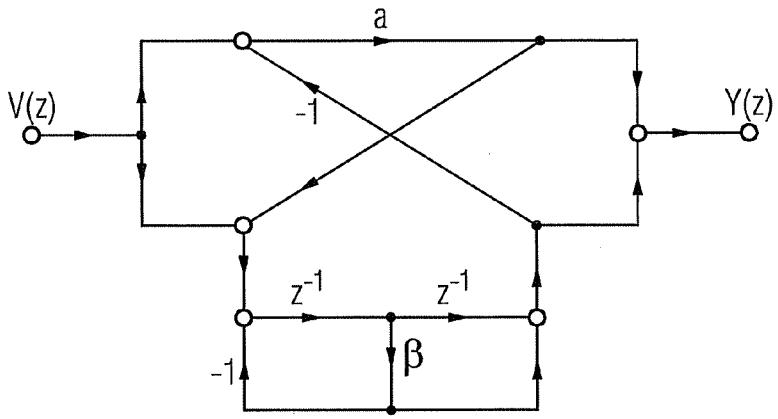
FIG. 7 shows a signal flow graph of a second degree all-pass.

The equalizer can be realized in cascade form here too, each first or second order block requiring one or two delay elements and one (two) multiplier(s). A corresponding first order canonic all-pass with a single multiplier is shown in FIG. 6, while a second order canonic all-pass with two multipliers is shown in FIG. 7.

Figure 8:
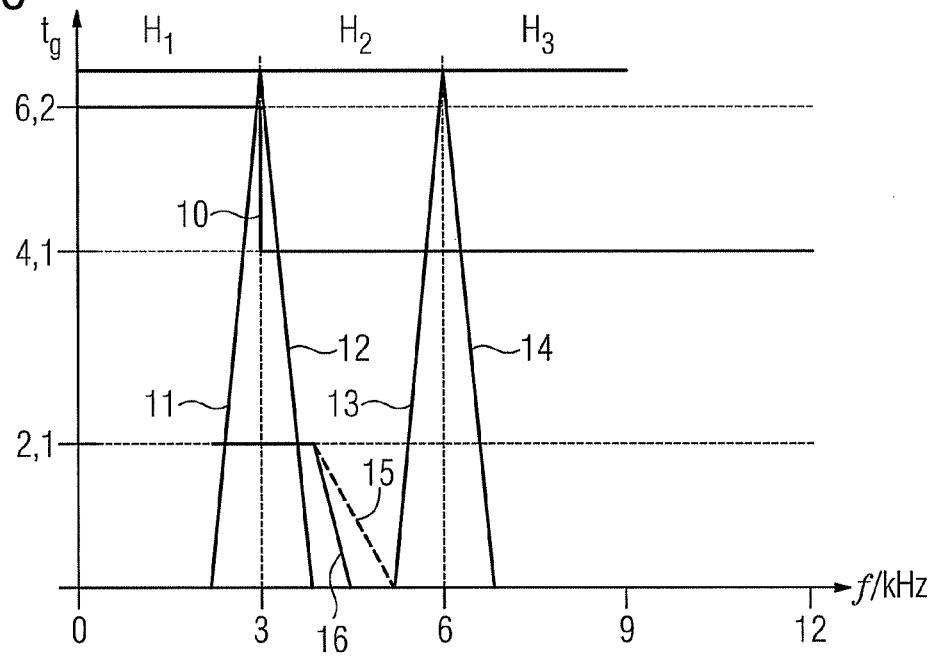
FIG. 8 shows a group delay time diagram with jump compensation.

6. The adjustment of the group delay time can be effected continuously by an all-pass in the equalization filter EQ. FIG. 8 shows the group delay time jump 10, which occurs without the delay time filter EQ. For the group delay time to be modified as monotonously as possible, the individual transition ranges 11, 12, 13 and 14 of the filter transmission functions $H_0$, $H_1$, $H_2$ of the filter banks FB3A, FB3B and FB3C should be taken into account. If the group delay time is to run monotonously instead of the jump 10, the equalization filter EQ can be used for example to add the group delay time, which results in FIG. 8 below the broken line 15, which connects the transition ranges 12 and 13 (see also FIG. 3). If we also want to keep the group delay time as short as possible for higher frequencies, the transition range for the group delay time can be further limited. The group delay time profile can then be kept rather steeper according to the continuous line 16.

Figure 9:
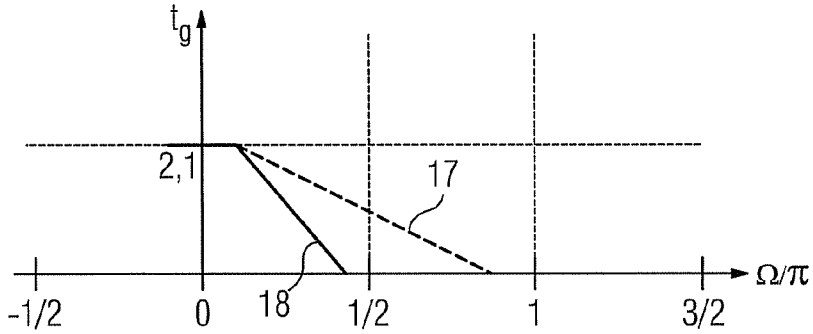
FIG. 9 shows the specification of a complex equalization filter.
Figure 10:
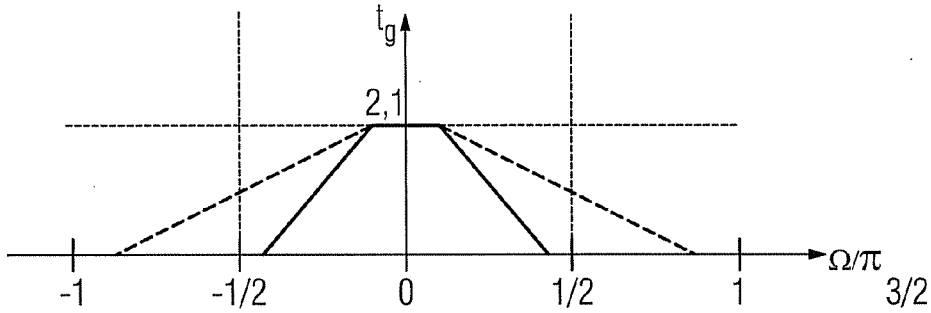
FIG. 10 shows the specification of an actual equalization filter.

The equalization filter EQ can be further optimized by designing the simplest all-pass possible, which complies approximately with the specification in FIG. 8. To this end in FIG. 9 the complex-valued specification (resulting from the processing of the signals by a for example complex-modulated filter bank) of an all-pass is first plotted after standardizing to the sampling rate $f_{zw}$ in the partial band. Here the broken line 17 describes a drop in the additionally introduced group delay time, which is technically required for perfect superimposition of the partial bands at least, and the continuous line 18 describes a steeper drop toward a shortest possible group delay time for higher frequencies. However an actual equalizer according to FIG. 10 can optionally also be used instead of a complex equalizer according to FIG. 9. The artifacts resulting from the symmetrical portions do not interfere here. The structure of an actual filter is however much simpler than that of a complex filter, so the actual filter should be preferred here.

The types of realization described above individually or in combination with one another allow an equalizer to be realized in one or a number of hierarchical planes in individual filter bank channels, to avoid abrupt transitions in the attenuation/amplification and/or group delay time.

The invention claimed is:

1. A hearing apparatus, comprising:

a filter bank system including:

a multi-stage analysis filter bank configured to break down an input signal of the hearing apparatus into a plurality of partial band signals by a plurality of filter bank channels, the multi-stage analysis filter bank including a first stage having a filter bank and a second stage having a plurality of filter banks distributed in the second stage of the multi-stage analysis filter bank, the plurality of filter bank channels of the filter bank in the first stage and of the plurality of filter banks in the second stage being in a hierarchical formulation;

a multi-stage synthesis filter bank to recombine partial band signals of the plurality of filter bank channels of the multi-stage analysis filter bank, the multi-stage synthesis filter bank including at least a first stage and a second stage, the first stage of the multi-stage analysis filter bank having a plurality of filter banks distributed therein, the second stage of the multi-stage analysis filter bank having a filter bank with a plurality of filter bank channels in a hierarchical formation; and an equalization filter connected to one of the plurality of filter bank channels of the multi-stage analysis filter bank or of the first stage of the multi-stage synthesis filter bank and of the filter banks of the second stage of the multi-stage filter bank.

2. The hearing apparatus as claimed in claim 1, wherein group delay time differences between filter bank channels selected from the group consisting of the plurality of filter bank channels of the multi-stage analysis filter bank and the plurality of filter bank channels of the multi-stage synthesis filter bank are equalized with the equalization filed.

3. The hearing apparatus as claimed in claim 1, wherein attenuation or amplification differences between filter bank channels selected from the group consisting of the plurality of filter bank channels of the multi-stage analysis filter bank and the plurality of filter bank channels of the multi-stage synthesis filter bank are equalized with the equalization filter.

4. The hearing apparatus as claimed in claim 2, wherein attenuation or amplification differences between filter bank channels selected from the group consisting of the plurality of filter bank channels of the multi-stage analysis filter bank and the plurality of filter bank channels of the multi-stage synthesis filter bank are equalized with the equalization filter.

5. The hearing apparatus as claimed in claim 1, wherein the equalization filter is disposed in the multi-state synthesis filter bank.

6. The hearing apparatus as claimed in claim 1, wherein the equalization filter is disposed in the multi-stage analysis filter bank.

7. The hearing apparatus as claimed in claim 5, wherein the equalization filter is disposed in the first stage of the multi-stage synthesis filter bank.

8. The hearing apparatus as claimed in claim 6, wherein the equalization filed is disposed in the first stage of the multi-stage analysis filter bank.

9. The hearing apparatus as claimed in claim 1, wherein the equalization filter is disposed in the second stage of the multi-stage synthesis filter bank.

10. The hearing apparatus as claimed in claim 1, wherein at least two pairs of adjacent filter banks are present in the filter bank system, the adjacent filter banks having filter bank channels of different bandwidth from one another, so that two filter bank channels of different bandwidth are respectively adjacent to one another in each filter bank pair and one equalization filter is disposed to increase the group delay time in the broader of the two filter bank channels, whenever increasing is required to equalize differences in the complex frequency response between the two filter bank channels.

11. The hearing apparatus as claimed in claim 2, wherein at least two pairs of adjacent filter banks are present in the filter bank system, the adjacent filter banks having filter bank channels of different bandwidth from one another, so that two filter bank channels of different bandwidth are respectively adjacent to one another in each filter bank pair and one equalization filter is disposed to increase the group delay time in the broader of the two filter bank channels, whenever increasing is required to equalize differences in the complex frequency response between the two filter bank channels.

12. The hearing apparatus as claimed in claim 3, wherein at least two pairs of adjacent filter banks are present in the filter bank system, the adjacent filter banks having filter bank channels of different bandwidth from one another, so that two filter bank channels of different bandwidth are respectively adjacent to one another in each filter bank pair and one equalization filter is disposed to increase the group delay time in the broader of the two filter bank channels, whenever increasing is required to equalize differences in the complex frequency response between the two filter bank channels.

13. The hearing apparatus as claimed in claim 1, wherein:

the equalization filter is connected to the two filter banks in different stages, an upstream stage and a downstream stage, and the equalization filter equalizes differences in the complex frequency responses between input filter bank channels of the filter bank in the downstream stage.

14. The hearing apparatus as claimed in claim 1, wherein the equalization filter equalizes differences in the complex frequency responses between at least an output channel of the equalization channel and an adjacent downstream channel.

15. The hearing apparatus as claimed in claim 1, wherein the equalization filter reduces the effects of discontinuities in group delay between adjacent partial bank signals.

16. The hearing apparatus as claimed in claim 13, wherein the equalization filter provides a continuous constant profile between the two filter banks.

17. The hearing apparatus as claimed in claim 13, wherein the hierarchical formation of the multi-stage analysis filter bank is a one to many relationship such that a single upstream filter bank feed into multiple down stream filter banks.

18. The hearing apparatus as claimed in claim 13, wherein the hierarchical formation of the multi-stage synthesis filter bank is a many to one relationship such that a plurality of upstream feed into a single down stream filter bank.

* * * * *